US006871031B2

(12) United States Patent
Blaine et al.

(10) Patent No.: US 6,871,031 B2
(45) Date of Patent: Mar. 22, 2005

(54) COUPLING MECHANISM FOR A TWO PIECE PRINTER CARTRIDGE

(75) Inventors: David Clay Blaine, Lexington, KY (US); John Andrew Buchanan, Lexington, KY (US); Philip Scot Carter, Lexington, KY (US); Matthew Thomas Kerley, Lexington, KY (US); Benjamin Keith Newman, Lexington, KY (US); Matthew Lee Rogers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 40 days.

(21) Appl. No.: 10/393,066

(22) Filed: Mar. 20, 2003

(65) Prior Publication Data

US 2004/0184834 A1 Sep. 23, 2004

(51) Int. Cl.[7] ..... G03G 21/18
(52) U.S. Cl. ..... 399/113
(58) Field of Search ..... 399/111, 113, 399/116, 119

(56) References Cited

U.S. PATENT DOCUMENTS

| | | | | |
|---|---|---|---|---|
| 5,028,966 A | | 7/1991 | Kozuka et al. | |
| 5,745,824 A | * | 4/1998 | Yashiro | 399/113 |
| 5,749,027 A | * | 5/1998 | Ikemoto et al. | 399/113 |
| 6,041,203 A | | 3/2000 | Suzuki et al. | |
| 6,070,029 A | * | 5/2000 | Nishiuwatoko et al. | 399/111 |
| 6,101,350 A | | 8/2000 | Suzuki et al. | |
| 6,173,140 B1 | * | 1/2001 | Suzuki et al. | 399/113 |
| 6,397,027 B2 | * | 5/2002 | Katakabe et al. | 399/113 |
| 6,678,489 B1 | | 1/2004 | Carter et al. | |
| 2003/0049046 A1 | | 3/2003 | Okabe | |

* cited by examiner

*Primary Examiner*—Robert Beatty
(74) *Attorney, Agent, or Firm*—Lexmark International, Inc.

(57) ABSTRACT

In a two piece toner cartridge assembly, as typically used in a computer and/or facsimile printing device, comprising separable photoconductor and developer units a unique coupling device is provided whereby the cartridge assembly may be removed from the printing device without the photoconductor unit separating from the developer unit for paper jam clearance or unit replacement. However, if desired the developer unit may be separately removed from the printing device for servicing or replacement without removal of the photoconductor unit.

12 Claims, 15 Drawing Sheets

COUPLING MECHANISM FOR A TWO PIECE PRINTER CARTRIDGE

TECHNICAL FIELD

The present invention generally relates to electrophotographic imaging devices and, more particularly to a two piece printer cartridge assembly having a separately replaceable developer and a photoconductor, which are typically biased together when installed in an imaging device such as a computer printer or facsimile machine. More specifically, the present invention relates to a blocking mechanism whereby the two piece cartridge may be removed as a combined assembly from the imaging device, or the developer unit, having the toner supply therein, may be singly removed for replacement by the user without having to remove the photoconductor.

PRIOR ART

Heretofore electrophotographic toner cartridges were of the unitary type typically including a developer section and a photoconductor section connected to one another so that the developer roller, of the developer, is pressed against the photoconductor drum, of the photoconductor, with a predetermined and controlled pressure. The controlled pressure is often provided by permanently installed springs stretching between the two units such that the two units are not separable, thereby forming a unitary or one piece replaceable cartridge.

Such one piece toner cartridges have the advantage of having the springs installed at the factory manufacturing the cartridge and since the springs have a relatively short operational life, the entire cartridge may be factory refurbished (or discarded) upon depletion of the toner supply whereupon new springs may be installed. However, such one-piece cartridges have the disadvantage that biasing springs must be included in each cartridge assembly thereby increasing the cost of manufacture and/or refurbishing. Also, for such one piece cartridges, replacement, by the user, of the toner section only, with a new toner section, is not practical since the units are not readily separated.

However, two piece cartridges are known in which the developer unit, having the toner, is readily separated from the photoconductor unit. When such two piece cartridges are installed in a typical printing device, they are manually brought together, by the user, and interconnected by a latching mechanism, such as a resilient latch, lever, or springs of some sort, whereby the two units are drawn together with the required pressure between the developer roll and the photoconductor roll for satisfactory imaging.

A disadvantage of such prior art cartridge assemblies is that the pressure applying mechanism must be installed on one or both of the units and therefore adds to supply costs, as both of the assemblies are typically replaceable as they are worn, as in the case of the photoconductor unit, or expended, as in the case of the developer unit.

A further disadvantage of the prior art two piece cartridge, is that such user involvement requires training and/or skill, on the part of the user, and requires an overall structural design which permits the user to easily reach the latching mechanism, between the two units, and activate or deactivate it. A further disadvantage is that the force biasing elements require space within the body of the imaging device.

SUMMARY OF THE INVENTION

The present invention provides for an easily separated two piece toner cartridge assembly, comprising a developer unit and a photoconductor unit which requires no force biasing mechanism between the developer unit and the photoconductor unit. The biasing force mechanism urging the developer unit and the photoconductor units together, with the desired pressure for use, is provided by the front cover of the imaging device, within which the toner cartridge is inserted, when the front cover, of the imaging device, is in the closed operational position. The developer and photoconductor units need only have conforming external configurations wherein they fit together requiring no interior space within the imaging device for accommodating a force biasing mechanism to urge the developer and photoconductor units together. No user involvement is necessary for urging the developer and photoconductor units together except for inserting the units into the imaging device and closing the cover of the imaging device. Although the biasing mechanism provided by the cover may comprise a spring or springs more costly than springs or other forcing mechanism which might be otherwise provided between the developer unit and the photoconductor unit, over the life of the imaging device the overall costs will typically be less.

A novel feature of the two piece toner cartridge taught herein comprises a blocking mechanism whereby the developer unit and the photoconductor unit may be locked together and removed from the imaging device as a unitary assembly or the developing unit may be unlocked from the photoconductor unit and singly removed from the imaging device for servicing or replacement. A blocking lever is provided within the handle of the photoconductor unit which, although not being in a physical latched relationship with the developer unit, nevertheless functions as a physical obstructing barrier preventing separation of the developer unit from the photoconductor unit when the blocking lever is in the blocking position thereby allowing removable of the photoconductor unit from the imaging device with the developer unit intact. To separate the developer unit from the photoconductor unit, the blocking lever is repositioned to an unlocked position, thereby permitting the developer unit to be separated from the photoconductor unit.

Thus by the present invention, a two piece toner cartridge may be removed from an imaging device and handled as a unitary assembly, or the two units may be easily separated from one another for separate servicing.

BRIEF DESCRIPTION OF THE DRAWINGS

The details of this invention will be described in connection with the accompanying drawings, in which.

DETAILED DESCRIPTION OF THE PREFERRED EMBODIMENT

Figure 1:
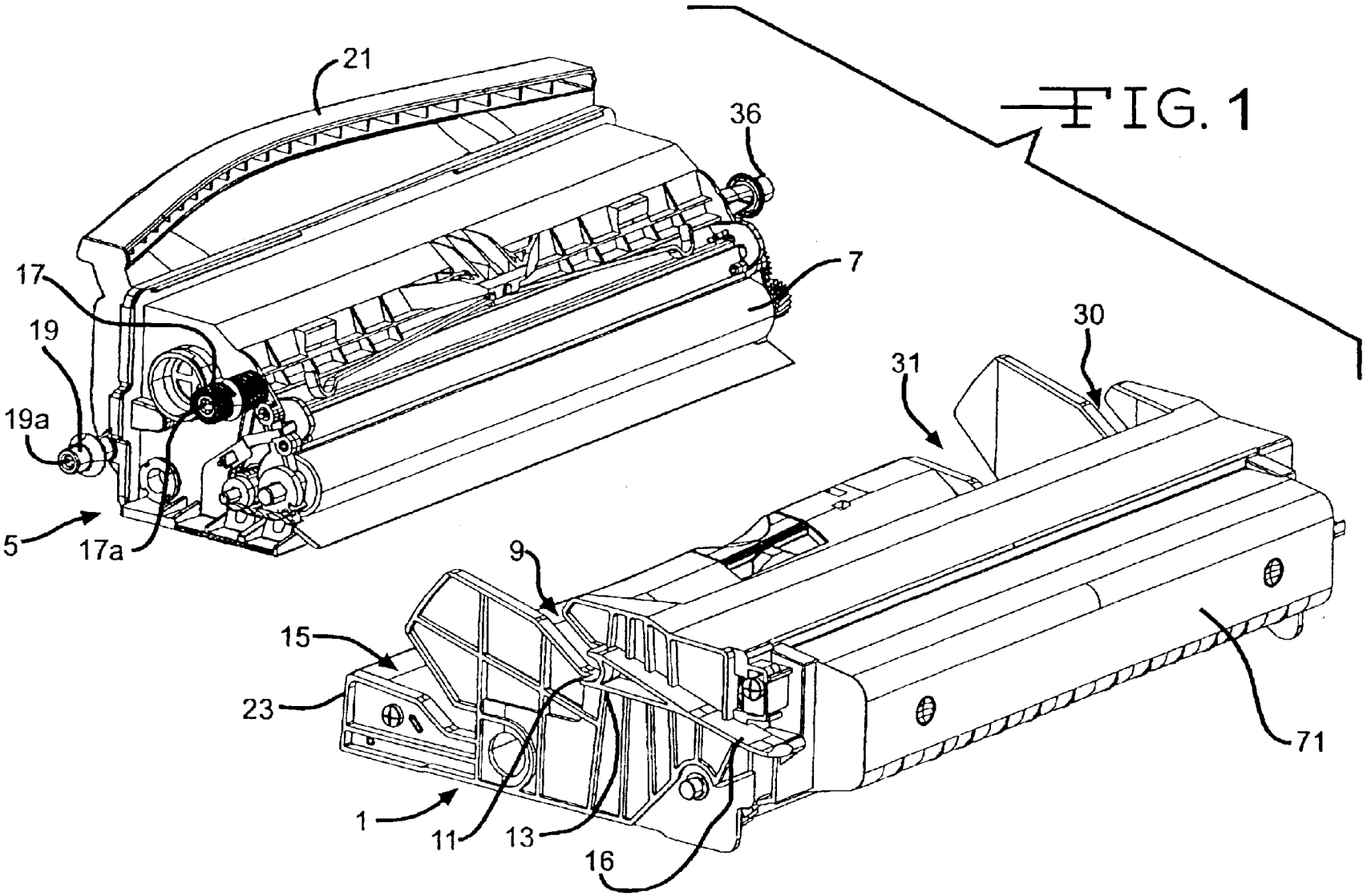
FIG. 1 is a perspective view showing the two piece toner cartridge having the developer unit separated from the photoconductor unit in accord with the present invention.

FIG. 1, presents a pictorial view of a two piece cartridge assembly illustrating the developer unit 5 separated from the photoconductor unit 1. Developer unit 5 includes the developer roller 7 and toner (not shown). The right side of photoconductor unit 1 includes an upper guide channel 9 ending in a flat section 11 having a rear wall 13. The right side of photoconductor unit 1 also includes a similar, lower guide channel 15. Planar member 16 is a guide for installation of photoconductor unit 1 within a printer. Similarly the left side of photoconductor unit 1 includes an upper guide channel 30 and a lower guide channel 31.

Figure 2:
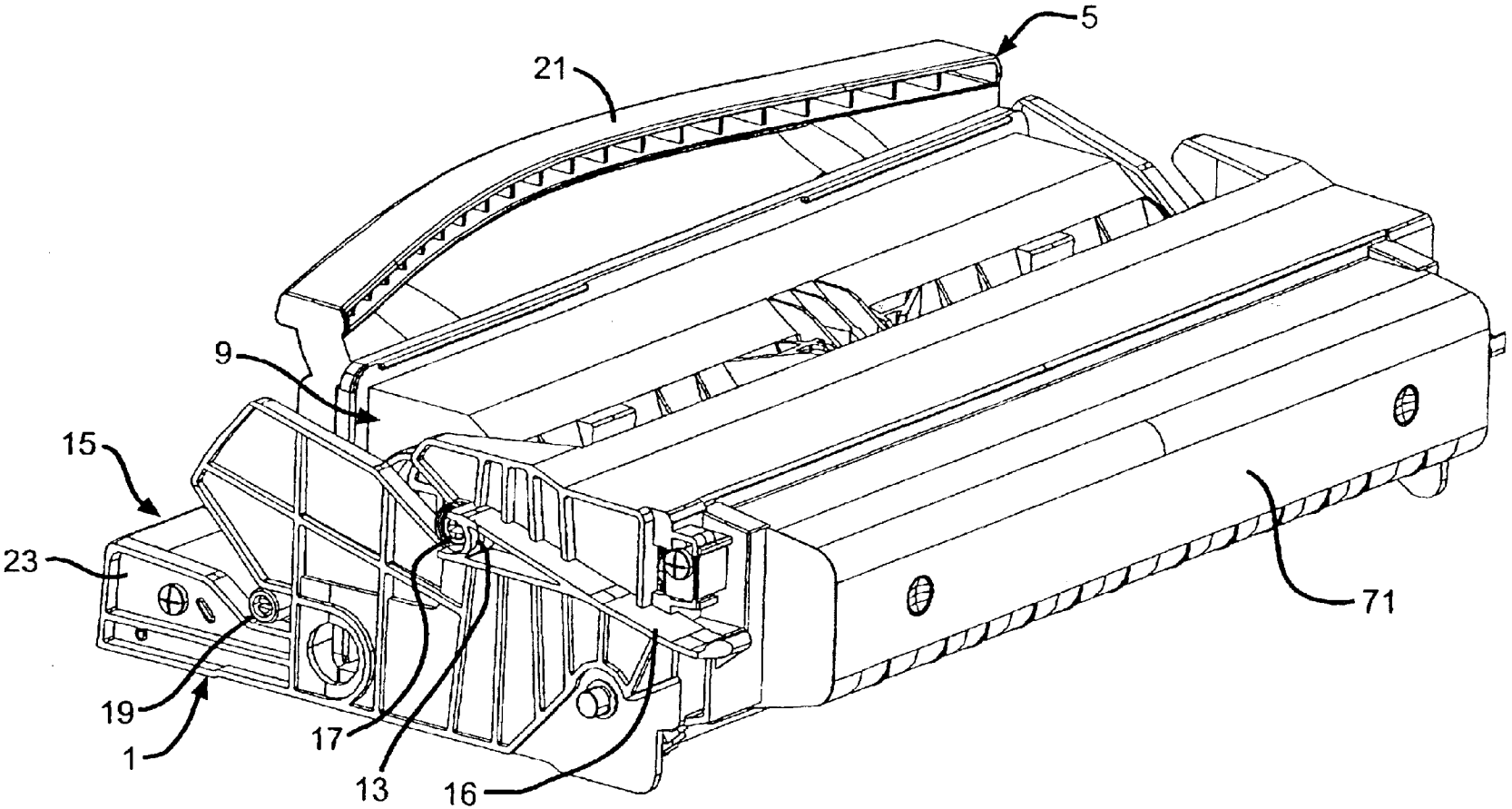
FIG. 2 is a perspective view of the two piece toner cartridge having the photoconductor unit and the developer unit assembled in accord with the present invention.
Figure 3:
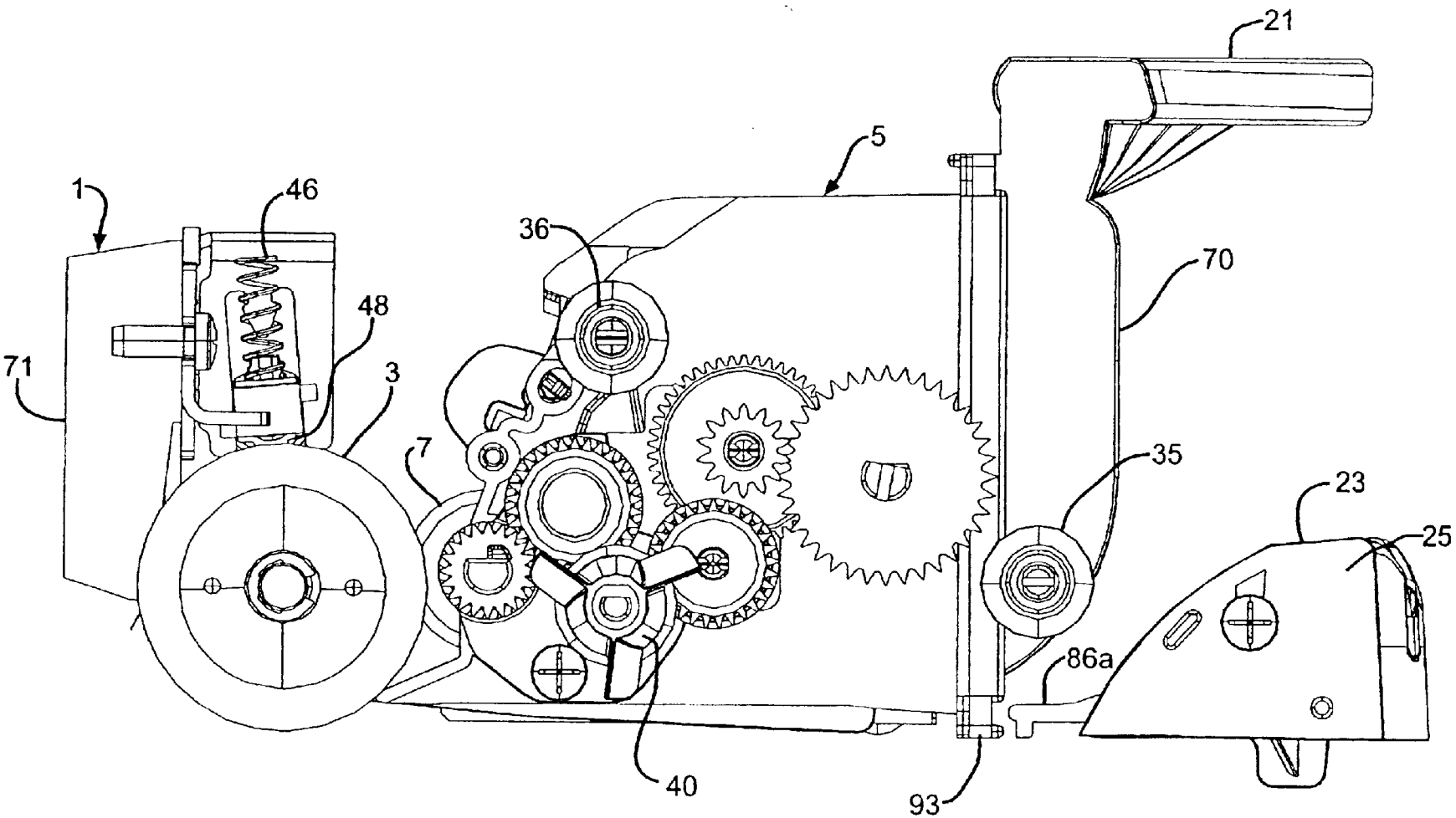
FIG. 3 is a left side view with covers removed, showing selected elements of the photoconductor and developer units of the two piece toner cartridge as an operating assembly with the blocking arms in their default, locked position.
Figure 4:
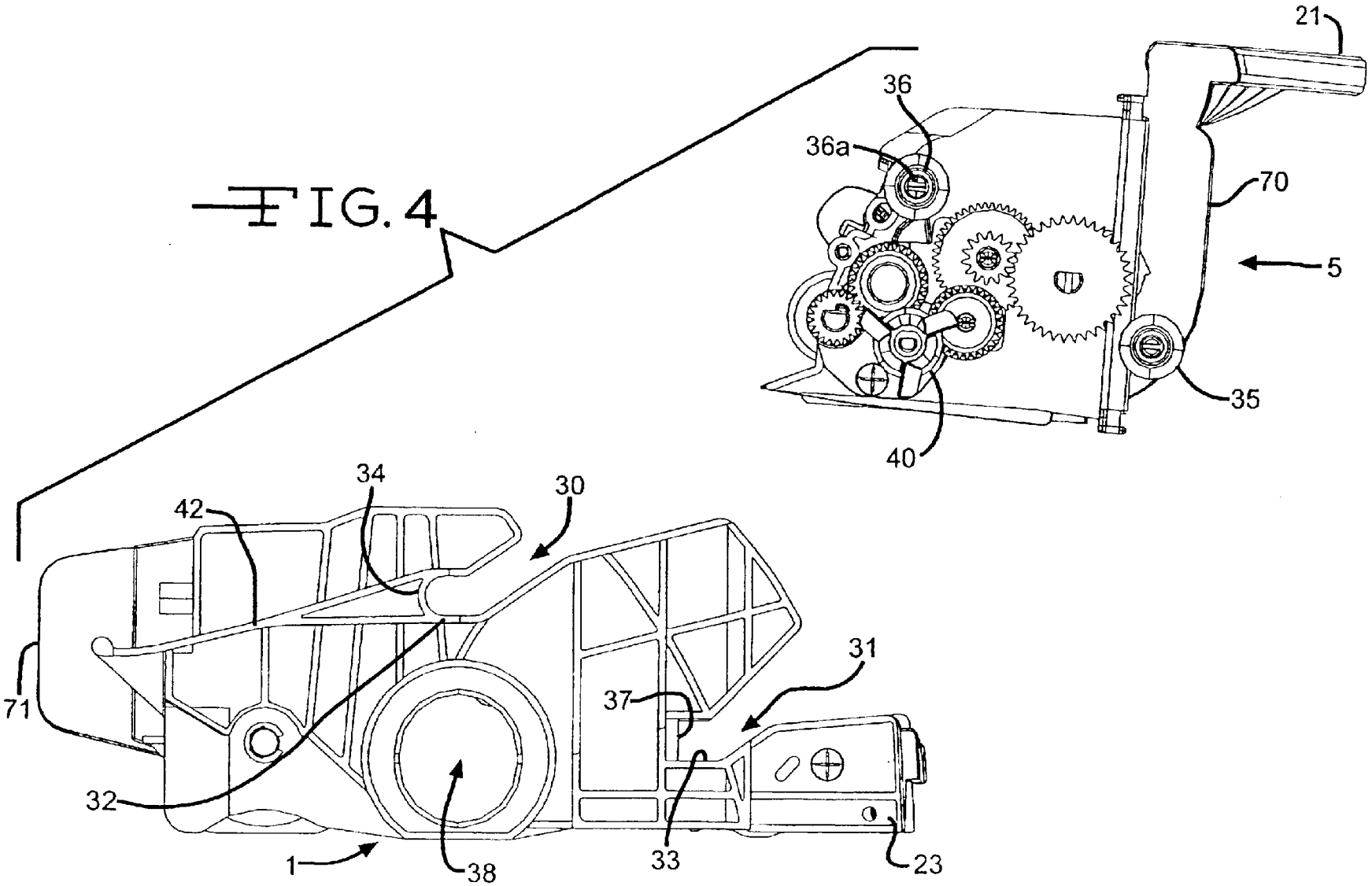
FIG. 4 is a left side view showing the photoconductor and developer units separated from one another.

The right side of developer unit 5 includes an upper guide stud 17 and a lower guide stud 19. Similarly the left side of developer unit 5 includes an upper guide stud 36 and a lower guide stud 35 as best illustrated in FIG. 4. FIG. 2 illustrates the photoconductor unit 1 and the developer unit 5 assembled in their normal working configuration. Guide stud 17 fits within channel 9 but does not reach wall 13. Similarly, guide studs 19, 35 and 36 fit within channels 15, 31 and 30 respectively. Thus channels 9, 15, 30 and 31 engage guide studs 17, 19, 36 and 35 respectively, (see FIGS. 2, 5, and 5*a*) thereby bringing developer roller 7 into an aligned contact with photoconductor drum 3 as illustrated in FIG. 3.

Figure 5:
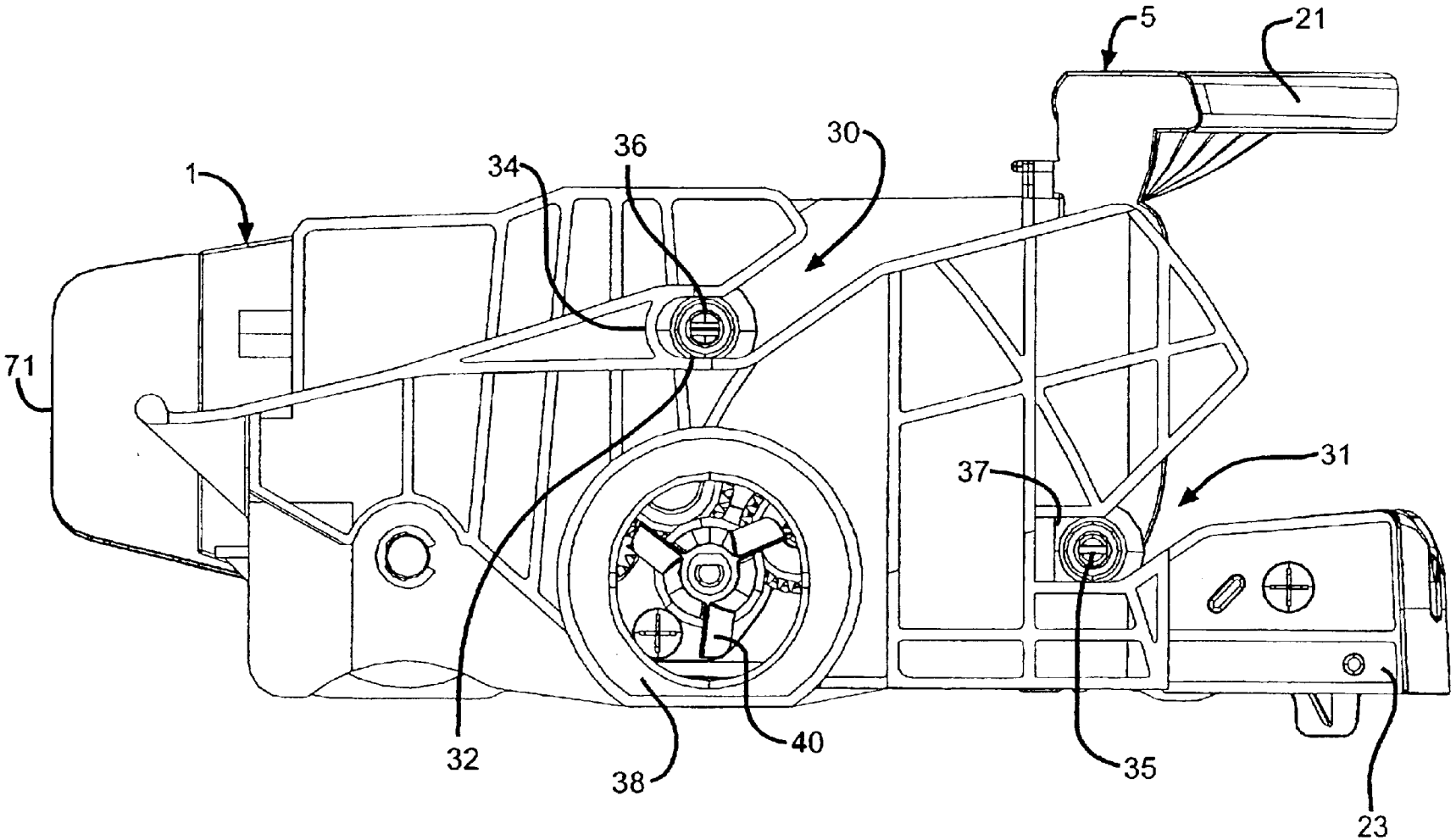
FIG. 5 is a left side view of the photoconductor and developer units assembled in accord with the present invention.
Figure 6:
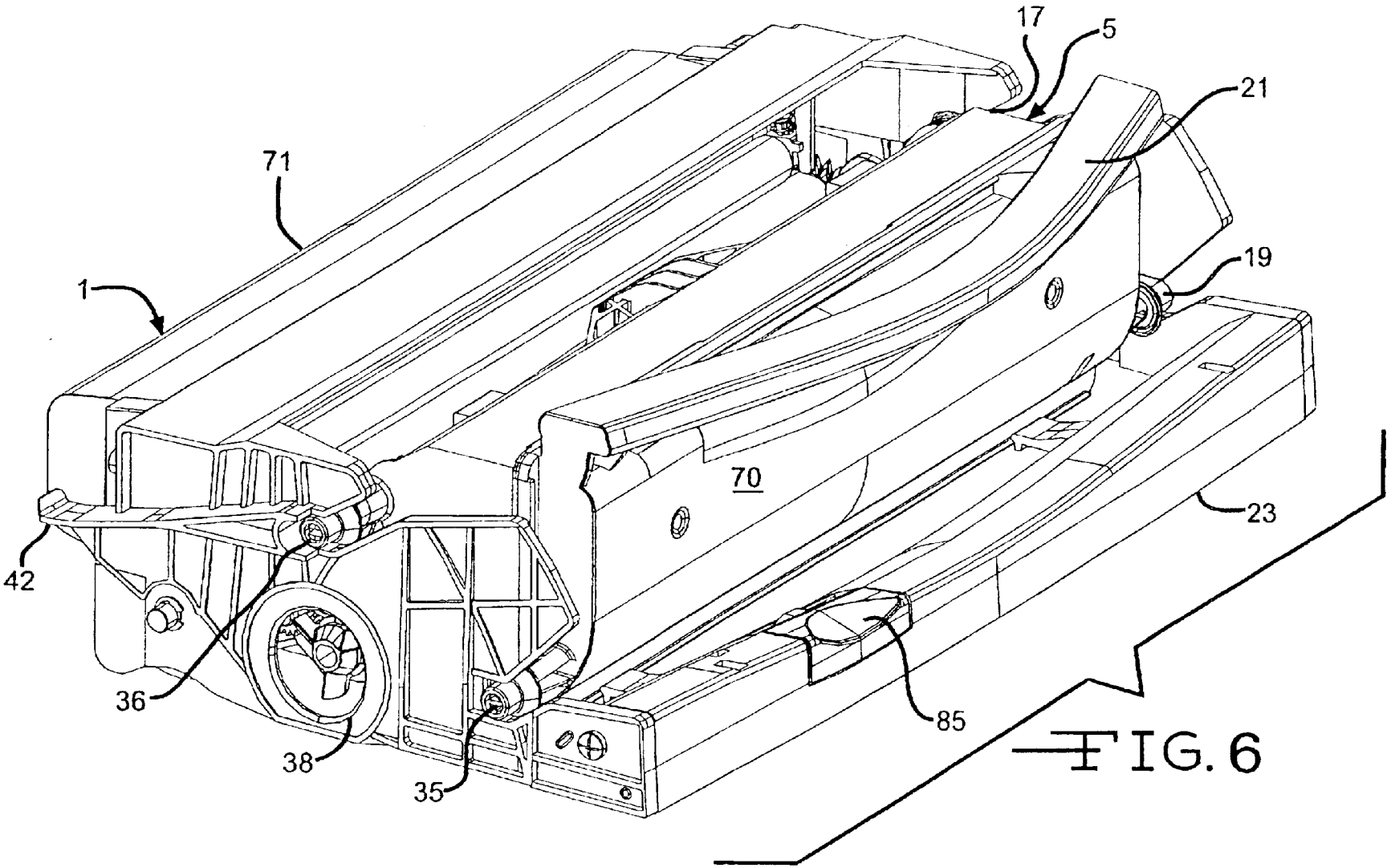
FIG. 6 is a reverse angle perspective view of FIG. 2 showing the photoconductor and developer units assembled in accord with the present invention.
Figure 7:
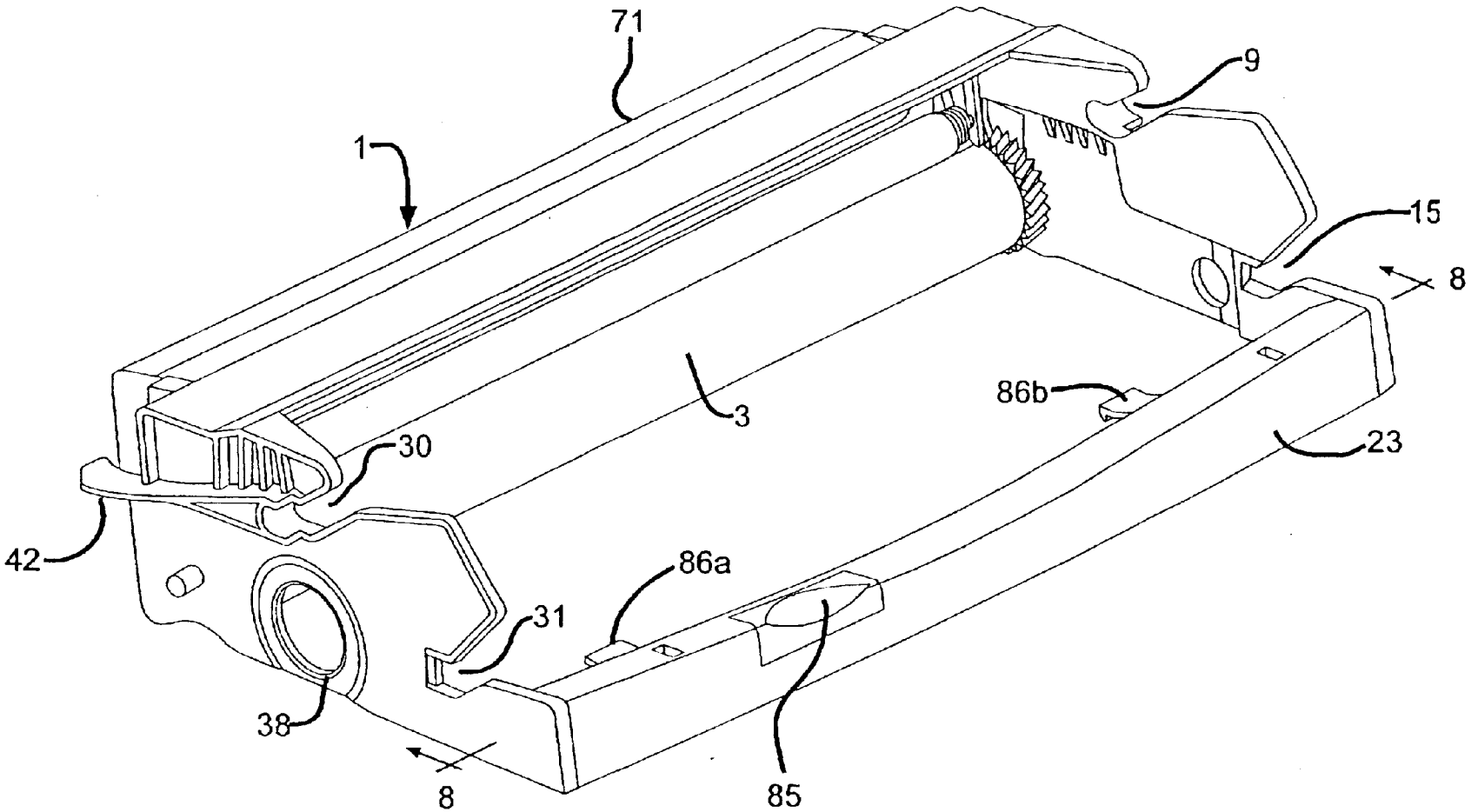
FIG. 7 is a perspective view of the photoconductor unit separated from the developer unit.
Figure 8:
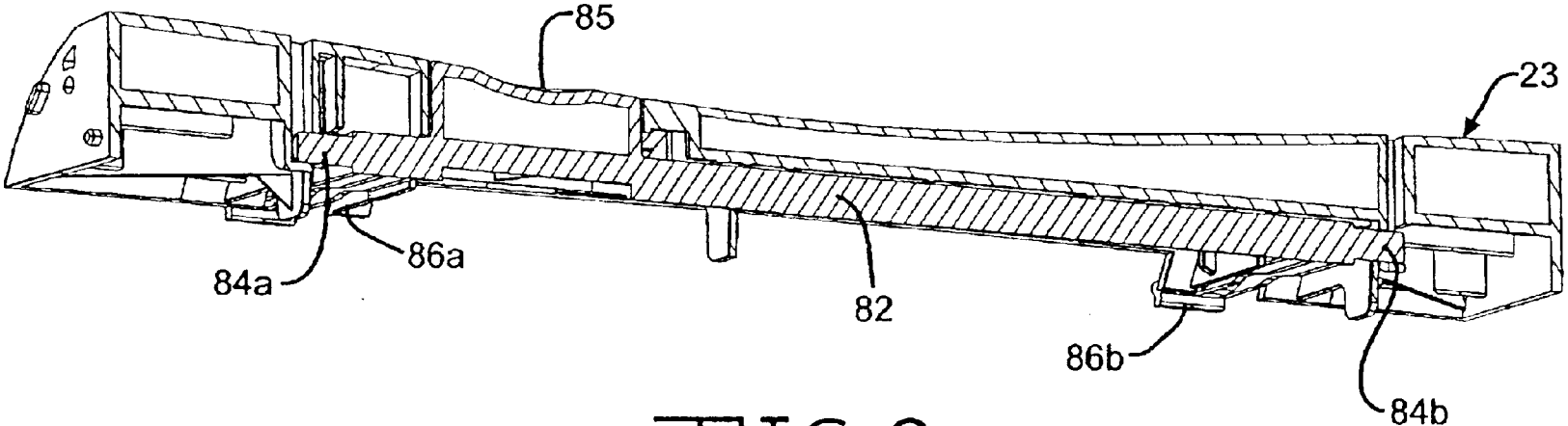
FIG. 8 is a sectional view taken along line 8—8 in FIG. 7.
Figure 9:
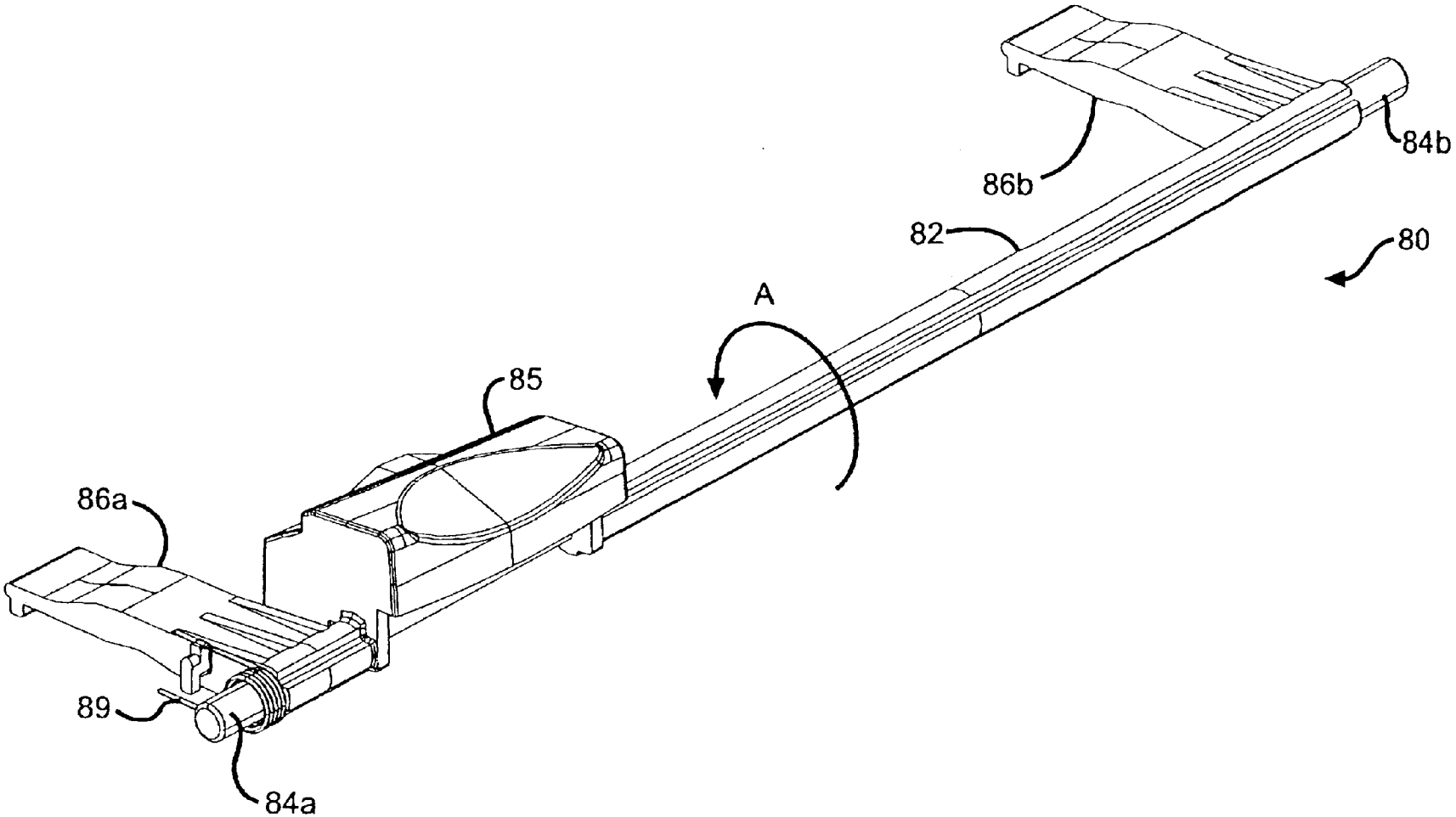
FIG. 9 presents a perspective view of the unit blocking assembly removed from the photoconductor handle.

Developer unit 5 also includes an upper handle 21, which can be readily grasped by the user to separately remove developer unit 5 from engagement with photoconductor unit 1. Photoconductor unit 1 is also provided with a lower handle 23 which extends slightly beyond developer unit 5 when the two units are combined as illustrated in FIGS. 3, 5 and 6. Included within handle 23 is a blocking mechanism 80, as illustrated in FIGS. 8 and 9 whereby developer unit 5 is blockingly restrained within photoconductor unit 1. Thus handle 23, or handle 21, may be grasped by the user to remove the photoconductor unit 1 and developer unit 5, as a coupled assembly, (see FIG. 6) from the printer device, without the developer unit separating from the photoconductor unit.

Turning now to FIGS. 7, 8, 8A and 9, blocking mechanism 80 is included within photoconductor handle 23 comprising an elongated torsion rod 82 having journal ends 84*a* and 84*b* at opposites ends thereof. Integral with rod 82 and positioned inward from journals 84*a* and 84*b* are radially extending blocking arms 86*a* and 86*b*.

Figure 8A:
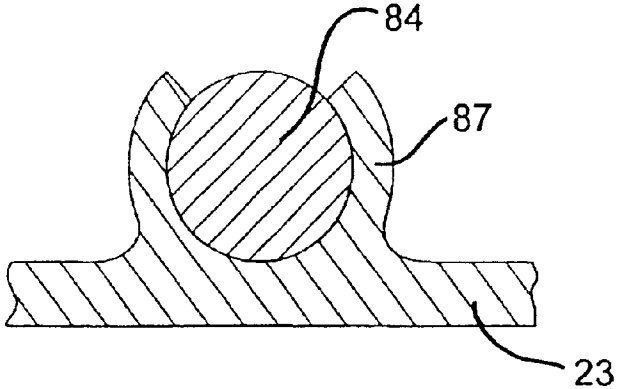
FIG. 8A is a partial schematic view of a typical method of attaching the unit blocking assembly to the photoconductor unit handle.

Journal ends 84*a* and 84*b* are rotatingly received within a pair of laterally opposed, over center, "C" shaped receptacles 87, integrally molded into the structure of handle 23 as illustrated in FIG. 8A, or any other suitable receptacle mounting within which rod 82 may freely rotate. Affixed to torsion rod 82 is an offset toggle button 85 for manually rotating torsion rod 82. Torsion spring 89 is attached to at least one of the blocking arms 86 such that the blocking mechanism 80 is biased to the default blocking position as illustrated in FIG. 3. Upon depressing button 85, torsion rod 82 will rotate counterclockwise, as indicated by arrow A in FIG. 9, thereby rotating blocking arms 86 downward as illustrated in FIG. 10.

When blocking arms 86 are in their default, blocking position, as illustrated in FIG. 3, there is a small clearance, or gap, provided between blocking arms 86 and the bottom edge 93 of developer unit 5 such that in an attempt to remove developer unit 5 from photoconductor unit 1, bottom edge 93, of developer unit 5, will physically contact blocking arms 86 thereby preventing separation of developer unit 5 from photoconductor unit 1.

Figure 11:
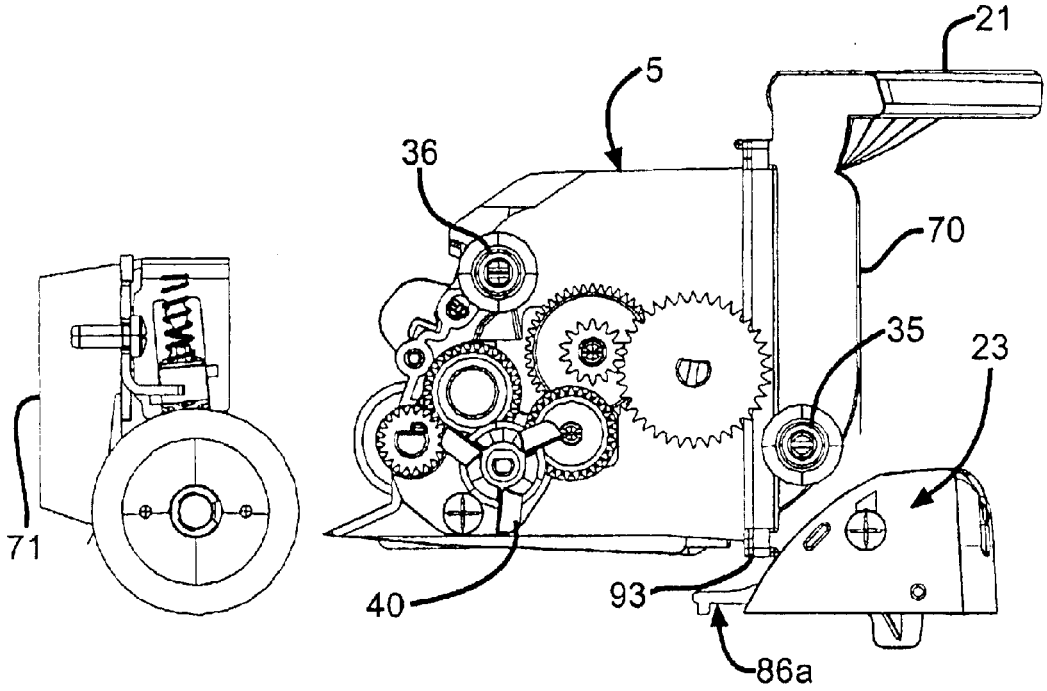
FIG. 11 is a left side view, similar to FIG. 3, showing the developer unit being removed from the photoconductor unit.

The physical contact between bottom edge 93 and blocking arms 86 is assured by the movement of guide studs 17, 19, 35 and 36 within their respective guide channels 9, 15, 31, and 30. In order to remove developer unit 5 from photoconductor unit 1, developer unit 5 must, by action of the guide channels, first translate horizontally before it can move upward and away from the photoconductor unit as illustrated in FIG. 11. Thus when blocking arms 86 are in their default blocking position, FIG. 3, developer unit 5 may not be separated from photoconductor unit 1.

Figure 10:
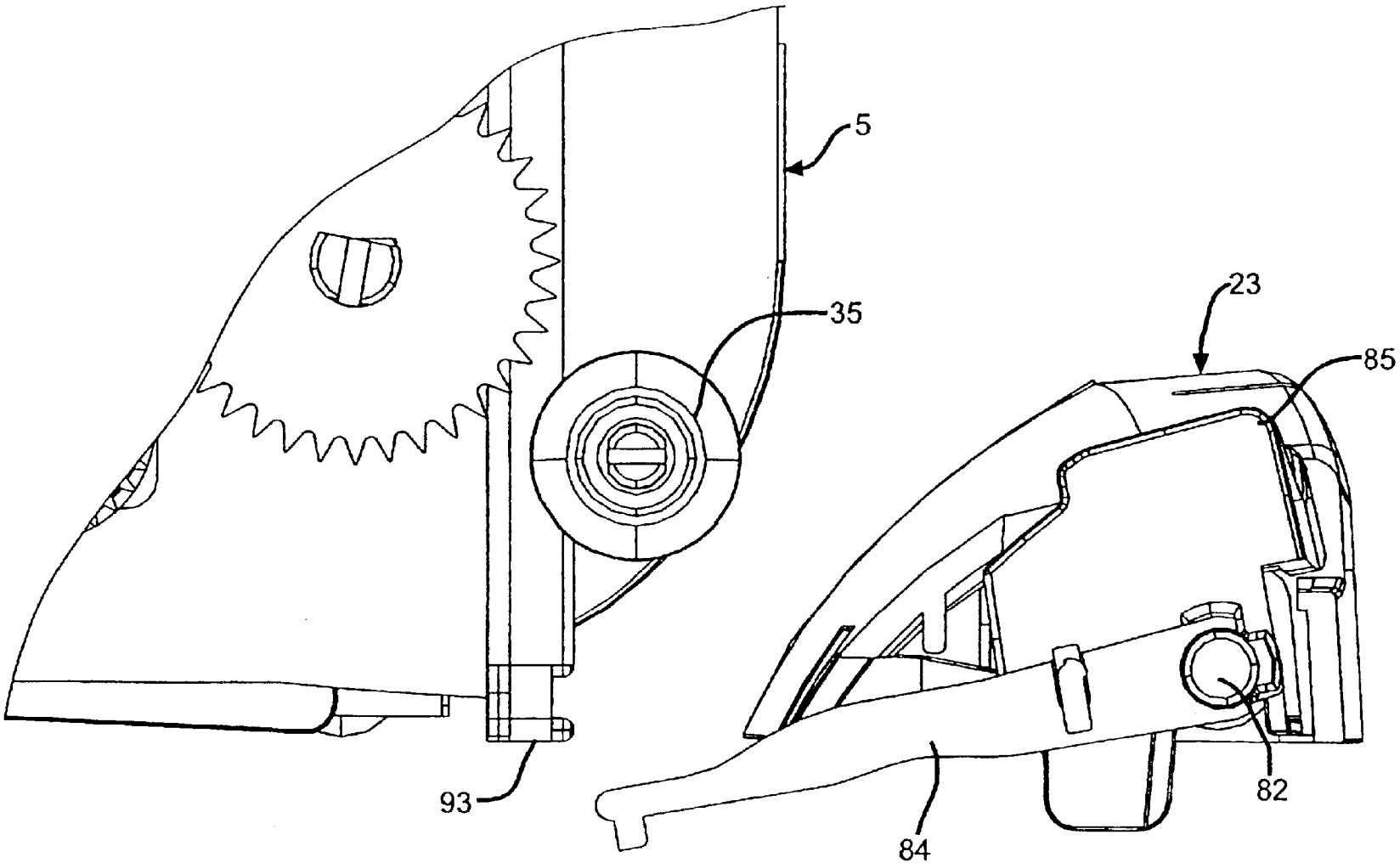
FIG. 10 is a partial left side view showing the blocking arms in their release position.

However, when blocking arms 86 are rotated downward, by the operator depressing toggle button 85, blocking arms 86 are removed from the path of bottom edge 93, as illustrated in FIG. 10 thereby permitting passage of bottom edge 93 and removal of developer unit 5 from photoconductor unit 1 as illustrated in FIG. 11. Accordingly handle 21 is used to remove both units 1 and 5 together and by rotating blocking arm 86 downward, to remove unit 5 alone. Handle 23 on unit 1 is used only rarely, when unit 1 is replaced or discarded.

Since developer unit 5 contains the toner used for imaging, the developer unit will be removed and replaced with a replacement developer unit more frequently than photoconductor unit 1. Photoconductor unit 1 will only be removed and replaced when the photoconductor unit becomes deteriorated or when the photoconductor unit's waste toner sump is judged to be full.

Referring to FIG. 4, units 1 and 5, are shown from the left side and separated. Photoconductor unit 1 includes a guide channels 30 and 31 ending in a flat section 32 and 33 and having a rear wall 34 and 37. Developer unit 5 includes a guide studs 36 and 35. The side wall of photoconductor unit 1 includes an opening 38 to provide external access to driven coupling 40 when developer unit 5 is installed within photoconductor unit 1 (See FIG. 5).

FIG. 5 illustrates units 1 and 5, as viewed from the left side, assembled in accordance with the present invention. Guide stud 36 is received in channel 30 but does not reach wall 34. Similarly guide stud 35 is received in channel 31 but does not reach wall 37. When assembled, as illustrated in FIGS. 2 and 5, channels 30, 31, 15, and 9 act to direct studs 36, 19, 17, and 35 respectively, thereby bringing developer roller 7 into aligned contact with photoconductor drum 3 (See FIG. 3). When units 1 and 5 are assembled as illustrated, in FIGS. 2 and 5, driven coupler 40 is aligned with opening 38 for access by a printer driving coupler (not shown).

The action of the drive coupling and the gears shown in FIGS. 3 and 4, will not be described in detail as they are essentially standard for imaging apparatus and drive known elements, not shown, including a toner, an adder roller and a toner mixing paddle, as well as the photoconductor drum 3 and developer roller 7. Similarly, with reference to FIG. 3, spring 46 biasing charge roller 48 against photoconductor 3 is standard and will not be further discussed.

Guide studs 17, 19, 35 and 36 preferably include external caps of polyacetal, a hard plastic, mounted on shafts integral with the body of developer unit 5. The body of developer unit 5 is preferably made of polystyrene. Polyacetal caps have a circumferential groove which meshes with small, radial tongues (not shown) extending into the grooves of the caps to thereby form studs 17, 19, 35 and 36. The polyacetal caps are free to rotate, but they may simply slide without loss of important function with respect to this invention. Alternative materials and construction of studs 17, 19, 35 and 36 could be readily employed by one skilled in this technology.

Figure 12:
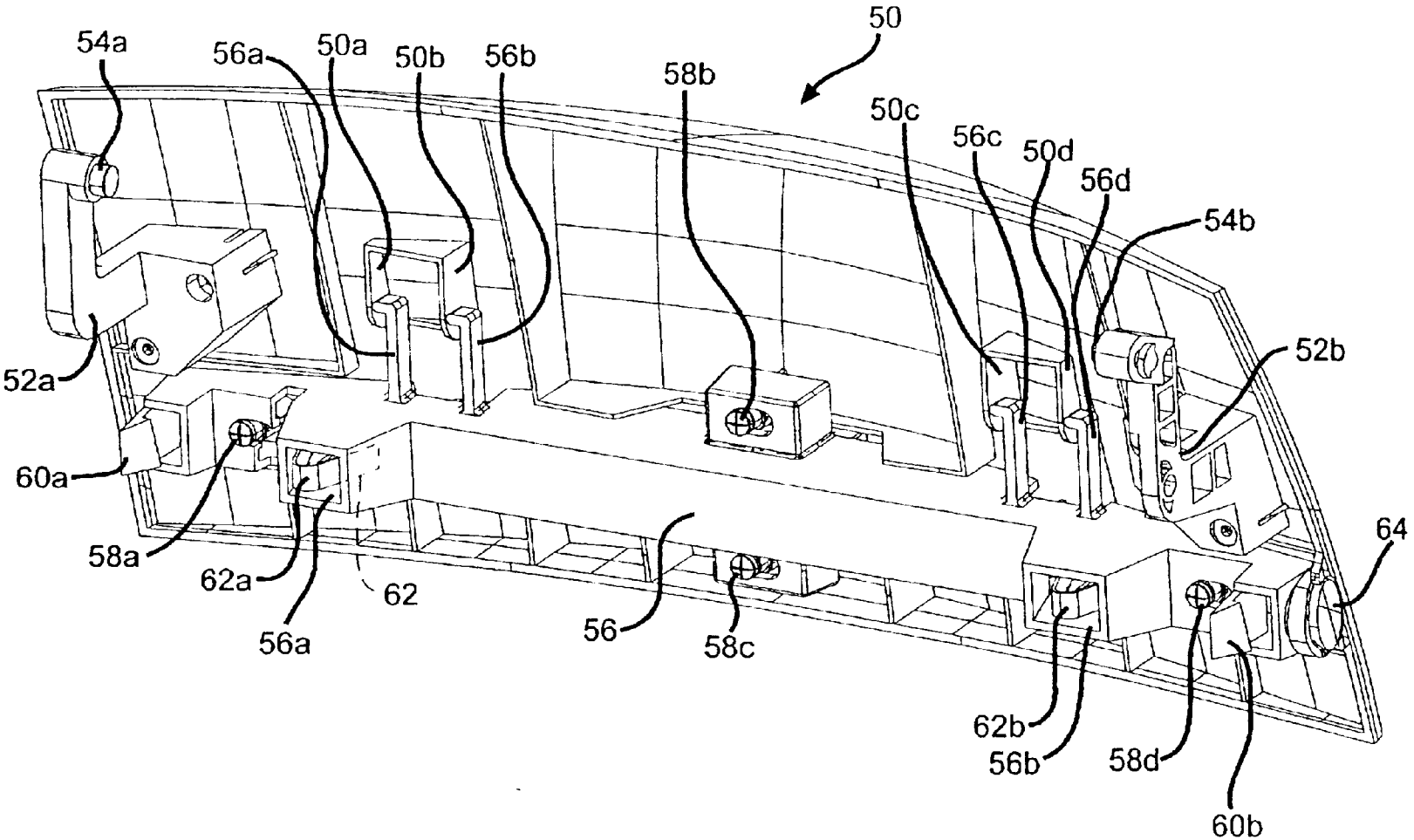
FIG. 12 is a perspective view showing the inside of the printer front cover.

Referring now to FIG. 12, the inside of printer cover 50 is illustrated, which may be made of any suitable, strong plastic. Mounted on opposite sides of cover 50 are pivot arms 52*a* and 52*b*, having near their ends pivot studs 54*a* and 54*b*. Pivot studs 54*a* and 54*b* enter frame F (See FIG. 12) of the printer structure (not shown) to define fixed pivot points for cover 50 relative to the frame F.

Mounted on the inside of cover 50 is one-piece housing 56, attached to cover 50 by four screws, 58*a*, 58*b*, 58*c* and 58*d*. Housing 56 includes latching members 60*a* and 60*b* on opposite sides of cover 50. Primarily significant to this invention, housing 50 confines a leaf spring 62, having opposed bent ends 62*a* and 62*b* which extend past housing 56 at openings 56*a* and 56*b* on opposite sides of cover 50.

Housing 56 includes integral, upward extending arms 56*a*, 56*b*, 56*c*, and 56*d* (see FIG. 12) which contact cover extensions 50*a*, 50*b*, 50*c*, and 50*d*. Screws 58*a*, 58*b*, 58*c*, and 58*d* are located in lateral, oval slots in housing 56. Integral with housing 56, on the left, is a flat, pressing surface or "button" 64. When cover 50 is closed, latching members 60*a* and 60*b* are pushed leftward by arms 56*a*, 56*b*, 56*c*, and 56*d* acting on extensions 50*a*, 50*b*, 50*c*, and 50*d*. A user pushing on button 64 overcomes this force and frees latches 60*a* and 60*b* to allow cover 50 to be opened.

Figure 13:
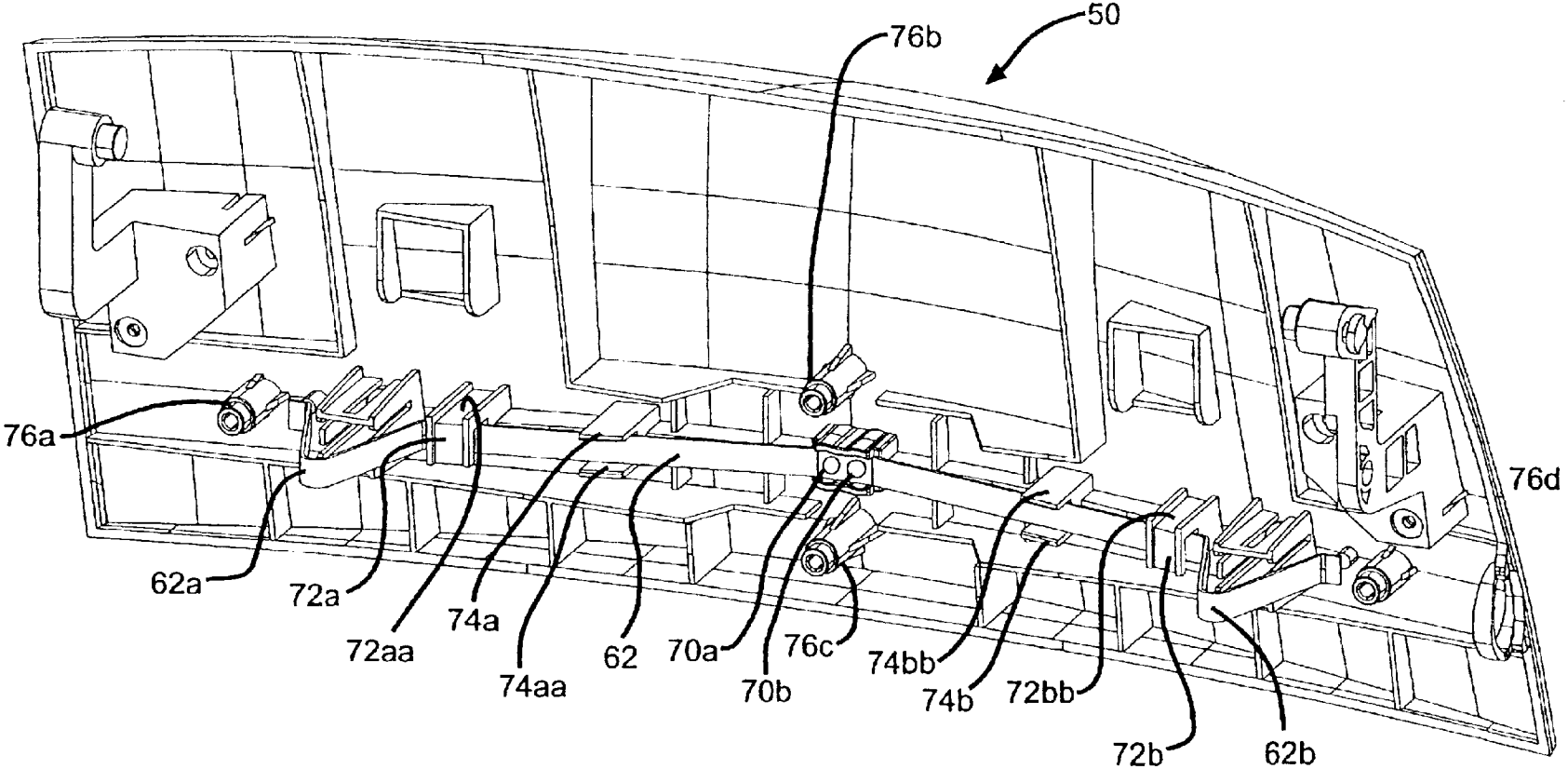
FIG. 13 is a perspective view of the printer front cover, similar to the view in FIG. 12, with a housing deleted to fully show the pressure spring mounting.

FIG. 13 presents a similar view as that in FIG. 12 with housing 56 and its integral assemblies deleted so as to better illustrate spring 62 and its mounting. In the embodiment illustrated in FIG. 13, spring 62, a single leaf spring, is attached to cover 50 by two screws 70*a*, 70*b* located at the center of spring 62. Spring 62 is held against undue movement away from cover 50 by spaced ledge members 72*a*, 72*b* on cover 50. Spring 62 is confined from undue lateral movement by extensions 72*aa* and 72*bb* holding ledge members 72*a* and 72*b* and by upper and lower spaced ledges 74*a*, 74*aa* and 74*b* and 74*bb*. Mounting posts 76*a*–76*d* receive screws 58*a*, 58*b*, 58*c*, and 58*d* (See FIG. 13).

Figure 14:
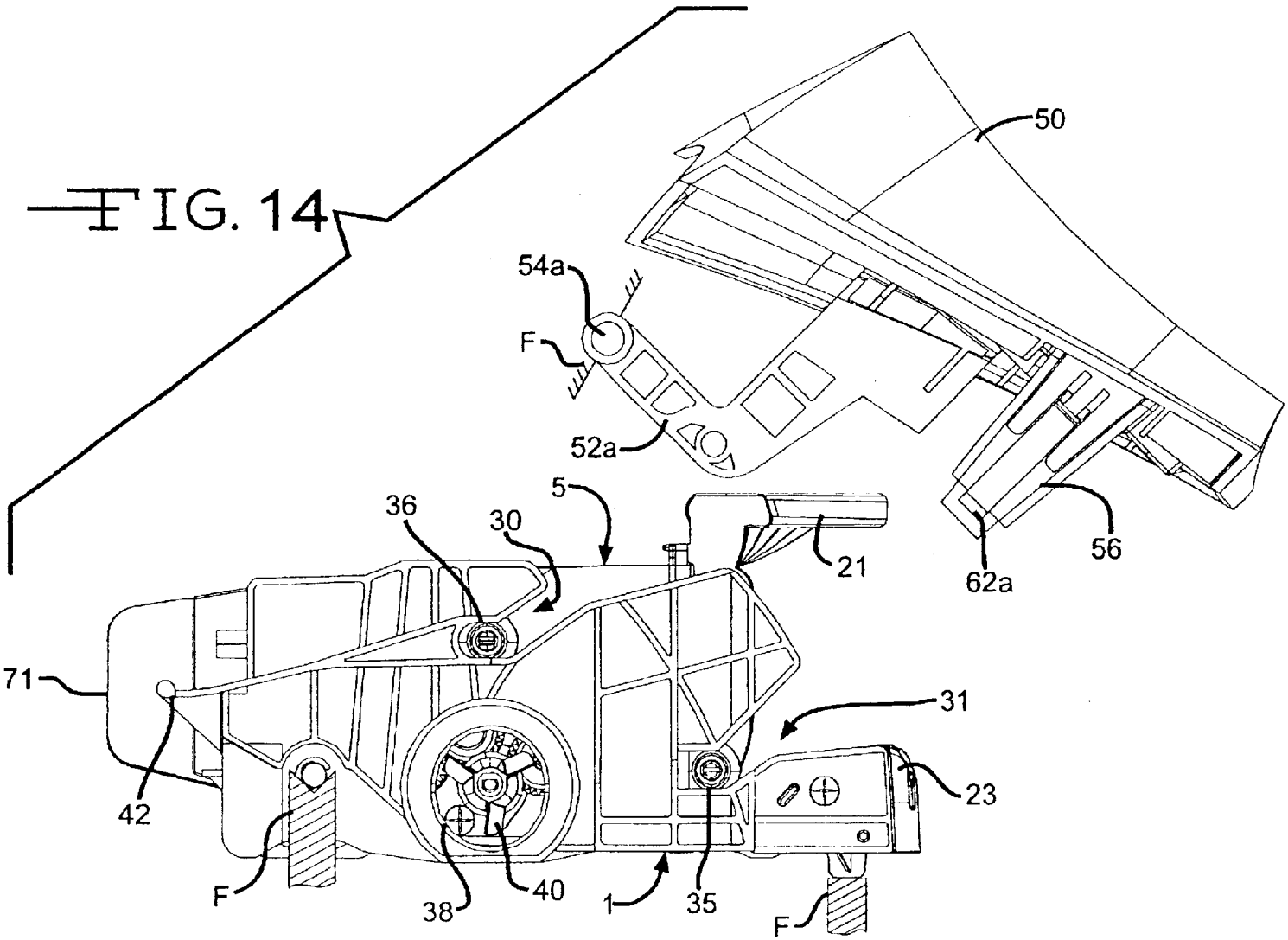
FIG. 14 is a left side view showing the printer cover, sectioned in the middle, illustrating the cover in the open position and the assembled toner cartridge as installed in a typical printer.

Referring now to FIG. 14, printer cover 50 is illustrated in an open position with the cartridge assembly, comprising developer unit 5 and photoconductor unit 1, in its installed position within the printer. The printer structure is illustrated as frame elements F. The installed photoconductor unit 1 and developer unit 5 are held in place and prevented from moving away from cover 50 by action of frame F.

Figure 15:
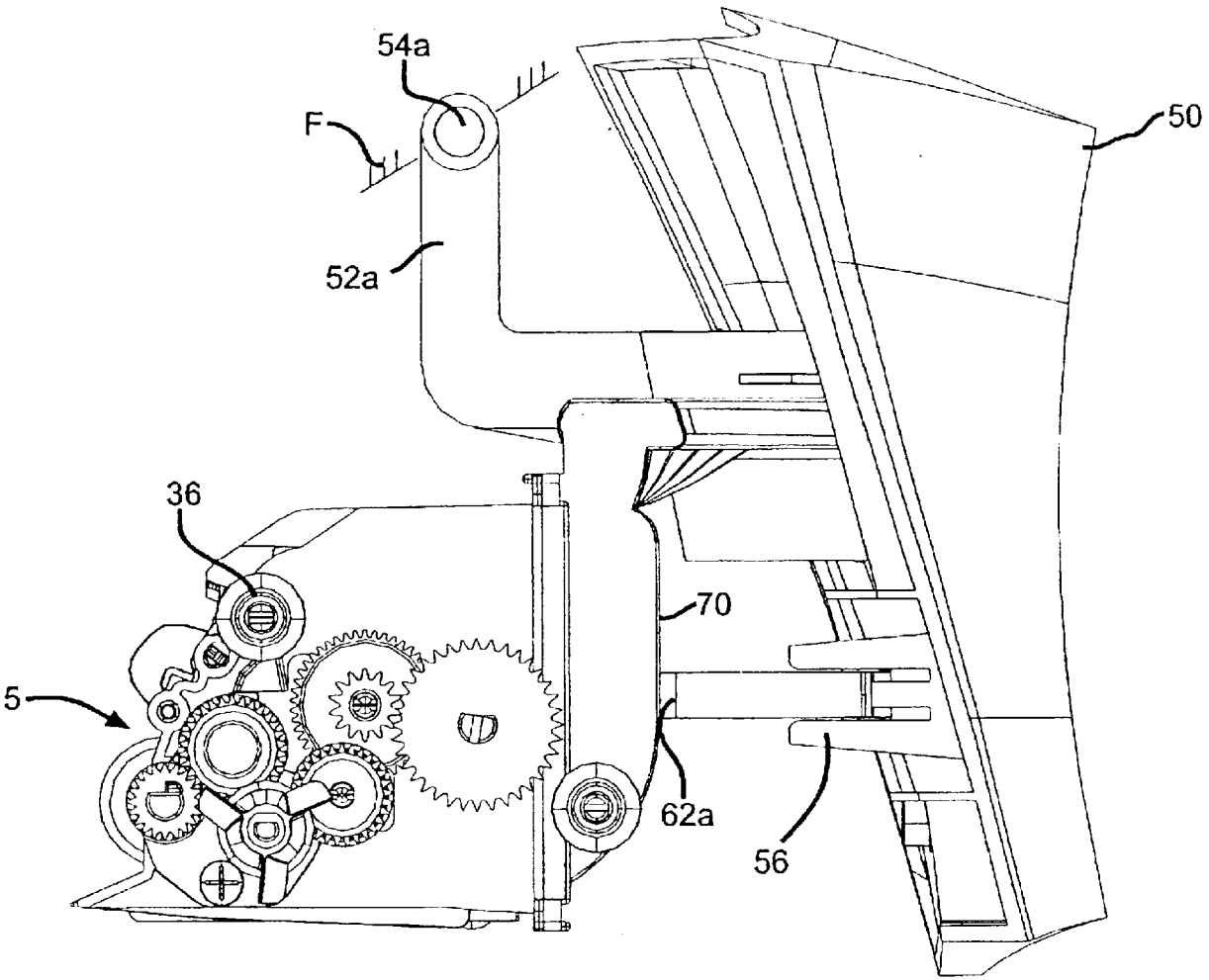
FIG. 15 presents a left side view, similar to that in FIG. 14, showing the printer cover pivoted to its final closed and operating position wherein the cover is applying a lateral force upon the developer unit thereby biasing the developer and photoconductor units together in accord with the present invention.

In FIG. 15 cartridge photoconductor unit 1 has been removed to better illustrate developer unit 5 and its interaction with cover 50 and is illustrated in its installed position. As illustrated in FIG. 15 developer unit 5 has a substantially vertical front wall 70. Upon closing cover 50, the ends 62*a* and 62*b* encounter front wall 70 of cartridge developer unit 5 thereby applying pressure against wall 70 urging developer unit 5 against photoconductor unit 1. Thus the installed units 1 and 5 are held against movement away from door 50 by frame members F of the printer. Latch members 60*a* and 60*b* (See FIG. 12) flex past ledges (not shown) in the printer frame F and latch over the ledges thereby securing cover 50 to the printer frame.

VARIATIONS AND ALTERNATIVES

Although a specific embodiment of the invention has been disclosed, there is no intent to thereby limit the invention to the specific embodiment illustrated herein. On the contrary, the intention herein is to cover all modifications, alternatives, embodiments, usage and/or equivalents of the subject invention as may fall within the spirit and scope of the invention as disclosed. Accordingly, the scope of the present invention is to be considered in terms of the following claims and understood not to be limited to the details of the structures and methods shown and described in the specification and drawings.

What is claimed is:

1. A replaceable two piece image forming cartridge for use in an image forming apparatus said cartridge comprising:

a photoconductor unit having a developer unit removably coupled thereto; and blocking means affixed to said photoconductor unit, said blocking means having a blocking position and a non-blocking position whereby said photoconductor unit and developer unit may be inserted into and removed from said image forming apparatus as an assembly when said blocking means is in the blocking position, and whereby said developer unit may be separately removed from said photoconductor unit when said blocking means is in the non-blocking position, said photoconductor unit having a handle for removing said photoconductor unit and said developer unit from said image forming apparatus as an assembly and wherein said handle includes said blocking means.

2. The two piece image forming cartridge as claimed in claim 1 wherein said developer unit includes a handle suitable for removing said photoconductor unit and said developer unit from said image forming apparatus as an assembly.

3. The two piece image forming cartridge as claimed in claim 1 wherein:

said photoconductor unit includes at least one guide channel for determining the path that the developer unit travels when said developer unit is coupled with, or removed from, said photoconductor unit and said blocking means includes at least one movable blocking arm having a blocking position and a non-blocking position, said movable blocking arm extending toward said developer unit such that the path traveled by said developer unit upon removal from said photoconductor unit is blocked by said blocking arm, whereby said developer unit is restricted from removal by said blocking arm.

4. The two piece image forming cartridge as claimed in claim 3 wherein said blocking means comprises:

a) a torsion rod rotatably attached to said handle, b) the at least one movable blocking arm affixed to said torsion rod and extending radially therefrom towards said developer unit, c) spring means for biasing said torsion rod and said blocking arm toward its blocking position, and d) a button affixed to said torsion rod whereby application of a force upon said button causes said torsion rod to rotate, thereby moving said blocking arm from said blocking position toward said non-blocking position.

5. A removable, two piece, image processing cartridge for use with an image forming machine wherein, a) said processing cartridge comprises a photoconductor unit upon which a detachable developer unit is mounted, b) a plurality of guide channels embodied within said photoconductor unit and a plurality of associated guide studs affixed to said developer unit such that said guide studs engage said guide channels thereby guiding said developer unit, into its desired operating position, along a predetermined path of travel when coupling said developer unit to said photoconductor unit and detachment therefrom, c) a handle attached to said photoconductor unit for removing said photoconductor unit and said developer unit from said image forming machine as a coupled assembly, said handle including at least one, movable blocking arm extending from said handle toward said developer unit, said blocking arm having a closed blocking position and an open non-blocking position, such that when said blocking arm is in its closed position, said blocking arm extends into the path of said developer unit as said developer unit is being removed from said photoconductor unit thereby preventing removal of said developer unit from said photoconductor unit and when said blocking arm is in its open non-blocking position, said blocking arm is removed from the path of said developer unit thereby permitting removal of said developer unit free from said photoconductor unit.

6. The two piece image processing cartridge as claimed in claim 5 wherein said blocking arm includes:

a) a torsion rod attached to one end of said blocking arm, said torsion rod rotatably attached to said handle, b) spring means biasing said torsion rod and said blocking arm to its closed blocking position, c) an eccentric toggle button affixed to said torsion rod whereby application of a force upon said toggle button causes said torsion rod to rotate, about its axis, thereby moving said blocking arm from said closed blocking position to said open non-blocking position.

7. In a two piece toner cartridge assembly comprising a photoconductor unit and a separable developer unit, a method of coupling the two assemblies together in a non-separable relationship comprising the steps of:

a) providing at least two guide channels within said photoconductor unit for receiving therein associated guide members affixed to said developer unit whereby the path of said developer unit, when assembling said developer unit to said photoconductor unit or separation of said developer unit from said photoconductor unit, is determined by the movement of said guide members within said guide channels, b) providing a movable blocking member upon said photoconductor unit, said blocking member having a blocking position and a non-blocking position whereby said blocking member, when in its blocking position, extends into said path of said developer unit thereby preventing said developer unit from being separated from said photoconductor unit and when said blocking member is in its non-blocking position said blocking member is removed from said developer unit's path thereby permitting separation of said developer unit from said photoconductor unit.

8. A replaceable two piece image forming cartridge for use in an image forming apparatus, said cartridge comprising: a) a first unit having a second unit removably coupled thereto, b) blocking means affixed to said first unit, said blocking means having a blocking position and a non-blocking position, whereby the image forming cartridge comprising said first and second units coupled together may be inserted into and removed from said image forming apparatus, when said blocking means is in its blocking position, and whereby said second unit may be removed from said first unit when said blocking means is in the non-blocking position, whereby said first unit without the second unit coupled thereto may be removed from said image forming apparatus.

9. The replaceable two piece image forming cartridge of claim 8 wherein the first unit includes a handle for removing the image forming cartridge from the imaging forming apparatus, and wherein the handle includes the blocking means.

10. A toner cartridge assembly for use in an image forming apparatus, the toner cartridge assembly comprising:

a developer unit;

a photoconductor unit configured to receive and retain the developer unit, the photoconductor unit including:

a blocking mechanism for inhibiting removal of the developer unit from the photoconductor unit when the blocking mechanism is in a blocking position, and for not inhibiting removal of the developer unit from the photoconductor unit when the blocking mechanism is in a non-blocking position;

a first handle for removing the toner cartridge assembly from the image forming apparatus; and a depressible button on the first handle and coupled to the blocking mechanism, the button for causing movement of the blocking mechanism from the blocking position to the non-blocking position when the button is depressed, such that the developer unit may be removed from the photoconductor unit when the button is depressed.

11. The toner cartridge assembly of claim 10 wherein the developer unit includes a second handle for removing the developer unit from the photoconductor unit when the button on the first handle is depressed.

12. The toner cartridge assembly of claim 10 wherein the developer unit includes a second handle for removing the toner cartridge assembly from the image forming apparatus when the button on the first handle is not depressed.

* * * * *